US010938186B2

(12) United States Patent
Akiyoshi et al.

(10) Patent No.: US 10,938,186 B2
(45) Date of Patent: Mar. 2, 2021

(54) SPARK PLUG ELECTRODE AND SPARK PLUG

(71) Applicant: DENSO CORPORATION, Kariya (JP)

(72) Inventors: Ryohei Akiyoshi, Kariya (JP); Ken Hanashi, Kariya (JP); Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/905,118

(22) Filed: Jun. 18, 2020

(65) Prior Publication Data

US 2020/0321756 A1 Oct. 8, 2020

Related U.S. Application Data

(63) Continuation of application No. PCT/JP2018/045821, filed on Dec. 13, 2018.

(30) Foreign Application Priority Data

Dec. 19, 2017 (JP) ..... JP2017-242673
Nov. 2, 2018 (JP) ..... JP2018-207496

(51) Int. Cl.
*H01T 13/39* (2006.01)
*H01T 13/32* (2006.01)

(52) U.S. Cl.
CPC ..... *H01T 13/39* (2013.01); *H01T 13/32* (2013.01)

(58) Field of Classification Search
CPC ..... H01T 13/20; H01T 13/32; H01T 13/39
See application file for complete search history.

(56) References Cited

U.S. PATENT DOCUMENTS

| | | | | |
|---|---|---|---|---|
| 6,094,000 | A | 7/2000 | Osamura et al. | |
| 2007/0222350 | A1 | 9/2007 | Lykowski et al. | |
| 2017/0222406 | A1 * | 8/2017 | Coupland | C22C 5/00 |
| 2019/0338395 | A1 | 11/2019 | Yokota et al. | |

FOREIGN PATENT DOCUMENTS

| | | | | |
|---|---|---|---|---|
| GB | 2557462 A * | 6/2018 | | C22C 5/04 |
| WO | WO-2016016667 A1 * | 2/2016 | | C22C 5/04 |
| WO | 2018/021028 | 2/2018 | | |
| WO | 2018/117135 | 6/2018 | | |
| WO | WO-2018104705 A1 * | 6/2018 | | C22C 5/04 |

* cited by examiner

*Primary Examiner* — Mariceli Santiago
(74) *Attorney, Agent, or Firm* — Nixon & Vanderhye PC

(57) ABSTRACT

A spark plug electrode is provided, in which an electrode member in which a total of 0.3 to 7.5 wt % of at least one of Ta and Nb is added to an IrRh alloy is provided at a discharge part.

10 Claims, 3 Drawing Sheets

SPARK PLUG ELECTRODE AND SPARK PLUG

CROSS-REFERENCE TO RELATED APPLICATION

The present application is a continuation application of International Application No. PCT/JP2018/045821, filed Dec. 13, 2018, which claims priority to Japanese Patent Application No. 2017-242673 filed on Dec. 19, 2017, and Japanese Patent Application No. 2018-207496 filed on Nov. 2, 2018. The contents of these applications are incorporated herein by reference in their entirety.

BACKGROUND

1. Technical Field

The present disclosure relates to an electrode to be used for a spark plug of an internal combustion engine.

2. Related Art

There is a spark plug electrode in which an IrRh alloy in which 3 to 30 wt % of Rh (rhodium) is added to Ir (iridium) is used as an electrode member for a discharge part.

SUMMARY

The present disclosure provides a spark plug electrode. As an aspect of the present disclosure, a spark plug electrode is provided, in which an electrode member in which a total of 0.3 to 7.5 wt % of at least one of Ta and Nb is added to an IrRh alloy is provided at a discharge part.

DETAILED DESCRIPTION OF THE PREFERRED EMBODIMENTS

Figure 1:
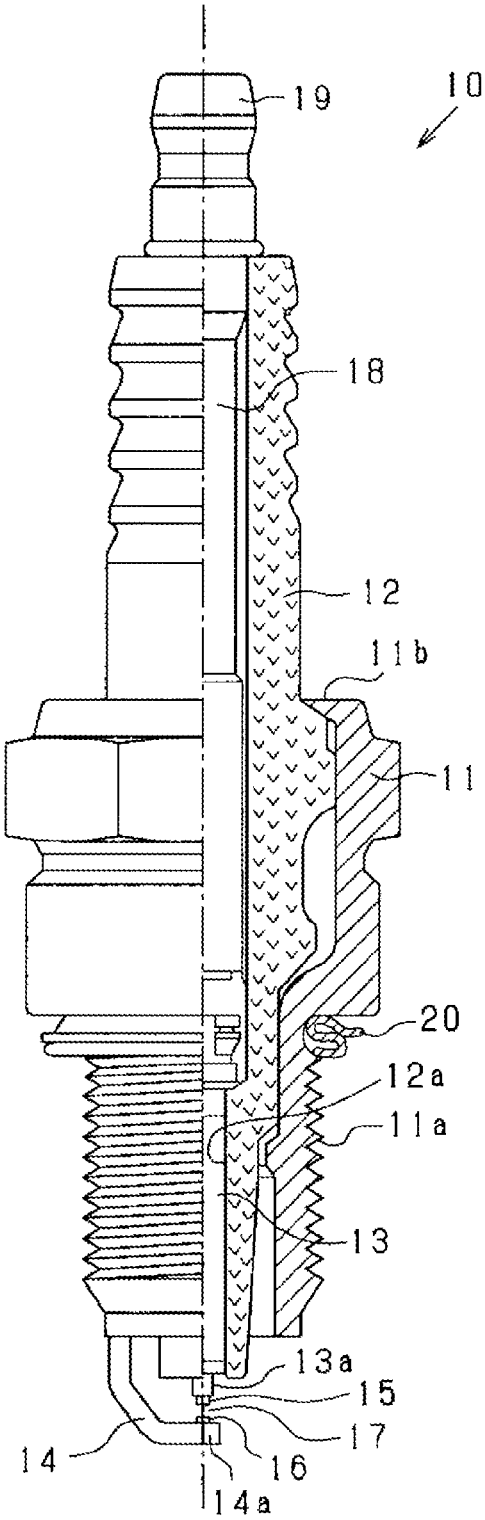
FIG. 1 is a half cross-sectional diagram of a spark plug.

Conventionally, among spark plug electrodes, there is a spark plug electrode in which an IrRh alloy in which 3 to 30 wt % of Rh (rhodium) is added to Ir (iridium) is used as an electrode member for a discharge part. According to the spark plug electrode disclosed in Japanese Patent No. 2877035 (JP 2877035 B), excellent high-temperature heat resistance is provided, while wear resistance can be improved.

In recent years, in an internal combustion engine, to realize higher output and improve fuel efficiency, a current and a voltage of a spark plug are made increasingly higher. It is therefore desired to further improve wear resistance for a spark plug electrode.

The present disclosure has been made to solve the above-described problem, and is mainly directed to providing a spark plug electrode which can realize further improved wear resistance.

A first aspect of the disclosure for solving the above-described problem is a spark plug electrode, in which an electrode member in which a total of 0.3 to 7.5 wt % of at least one of Ta and Nb is added to an IrRh alloy is provided at a discharge part.

According to the above-described configuration, the electrode member is provided at the discharge part of the spark plug electrode. Therefore, discharging of the spark plug is performed at the electrode member. The electrode member is an IrRh alloy, preferably an IrRh alloy contains 5 to 50 wt % of Rh, and more preferably an IrRh alloy contains 5 to 30 wt % of Rh. Therefore, it is possible to suppress volatilization and consumption of Ir due to generation of an oxide at high temperatures, with Rh which is less likely to volatilize at high temperatures.

Further, in the electrode member, a total of 0.3 to 7.5 wt %, preferably a total of 0.3 to 6 wt % of at least one of Ta (tantalum) and Nb (niobium) is added to the above-described IrRh alloy. It has been confirmed by the discloser of the present application that wear resistance is improved by a total of equal to or greater than 0.3 wt % of at least one of Ta and Nb being added to the IrRh alloy. Because melting points of Ta and Nb are higher than that of Rh, it is estimated that melting and scattering of the electrode member upon spark discharge can be suppressed. However, it has been confirmed by the discloser of the present application that, if a total additive amount of Ta and/or Nb exceeds 6 wt % and becomes equal to or greater than 8 wt %, wear resistance is lowered. It is believed that wear resistance is lowered due to grain boundaries becoming brittle as a result of Ta and/or Nb segregating at the grain boundary. Concerning this point, according to the above-described configuration, it is possible to further improve wear resistance of the spark plug electrode. Further, in the electrode member, it is also possible to add 0.3 to 7.5 wt %, preferably 0.3 to 6 wt % of Ta to the above-described IrRh alloy without adding Nb.

In a second aspect of the disclosure, a total of 1 to 5 wt % of at least one of Ta and Nb is added to the electrode member. It has been confirmed by the discloser of the present application that wear resistance is further improved by a total of 1 to 5 wt % of at least one of Ta and Nb being added to the IrRh alloy. Therefore, according to the above-described configuration, it is possible to further improve wear resistance of the spark plug electrode. Further, it is also possible to add 1 to 5 wt % of Ta to the electrode member without adding Nb.

In a third aspect of the disclosure, a total of 0.3 to 3 wt % of at least one of Ni (nickel) and Co (cobalt) is added to the electrode member. It has been confirmed by the discloser of the present application that wear resistance is improved by a total of equal to or greater than 0.3 wt % of at least one of Ni and Co being added to a material in which a total of 0.3 to 7.5 wt %, preferably a total of 0.3 to 6 wt % of at least one of Ta and Nb is added to the IrRh alloy. It is estimated that volatilization and consumption of Ir due to generation of an oxide can be suppressed by at least one of Ni and Co being added. However, it has been confirmed by the discloser of the present application that, if a total additive amount of Ni and/or Co exceeds 3 wt %, wear resistance is lowered. It is believed that this is because melting points of Ni and Co are lower than those of Ir and Rh, so that melting and scattering of the electrode member upon spark discharge increase. Concerning this point, according to the above-described configuration, it is possible to further improve wear resistance of the spark plug electrode. Further, it is also possible to add a total of 0.3 to 3 wt % of at least one of Ni and Co to a material in which 0.3 to 7.5 wt %, preferably 0.3 to 6 wt % of Ta is added to the IrRh alloy, without Nb being added.

In a fourth aspect of the disclosure, a total of 0.5 to 1.5 wt % of at least one of Ni and Co is added to the electrode member. It has been confirmed by the discloser of the present application that wear resistance is further improved by a total of 0.5 to 1.5 wt % of at least one of Ni and Co being added to a material in which a total of 0.3 to 7.5 wt %, preferably a total of 0.3 to 6 wt % of at least one of Ta and Nb is added to the IrRh alloy. Therefore, according to the above-described configuration, it is possible to further improve wear resistance of the spark plug electrode. Further, it is also possible to add a total of 0.5 to 1.5 wt % of at least one of Ni and Co to a material in which 0.3 to 7.5 wt %, preferably 0.3 to 6 wt % of Ta is added to the IrRh alloy without Nb being added.

A fifth aspect of the disclosure is a spark plug including the spark plug electrode according to any one of the first to the fourth aspects.

The above and other objects, features and advantages of the present disclosure will become more clear from the following detailed description with reference to the accompanying drawings.

An embodiment embodied in a spark plug to be used at an internal combustion engine will be described below with reference to the drawings.

As illustrated in FIG. 1, a spark plug 10 includes a cylindrical housing 11 formed of a metal material such as iron. A screw portion 11*a* is formed around an outer periphery at a lower portion of the housing 11.

Inside the housing 11, a lower end portion of cylindrical insulating glass 12 is coaxially inserted. The insulating glass 12 is formed of an insulating material such as alumina. The housing 11 and the insulating glass 12 are integrally coupled by an upper end portion 11*b* of the housing 11 being pressed against the insulating glass 12. Then, a center electrode 13 is inserted into a through-hole 12*a* (hollow portion) and held at a lower portion (one end portion) of the insulating glass 12.

The center electrode 13 (spark plug electrode) is formed in a columnar shape using a Ni alloy which excels in heat resistance, or the like, as a base material. Specifically, an inner material (core material) of the center electrode 13 is formed of copper, and an outer material (skin material) is formed of a Ni (nickel)-based alloy. A tip portion 13*a* of the center electrode 13 is exposed from a lower end (one end) of the insulating glass 12.

At a position facing the tip portion 13*a* of the center electrode 13, a ground electrode 14 which integrally curves and extends from a lower end face (one end face) of the housing 11 is disposed. The ground electrode 14 (spark plug electrode) is also formed of a Ni-based alloy.

Figure 2:
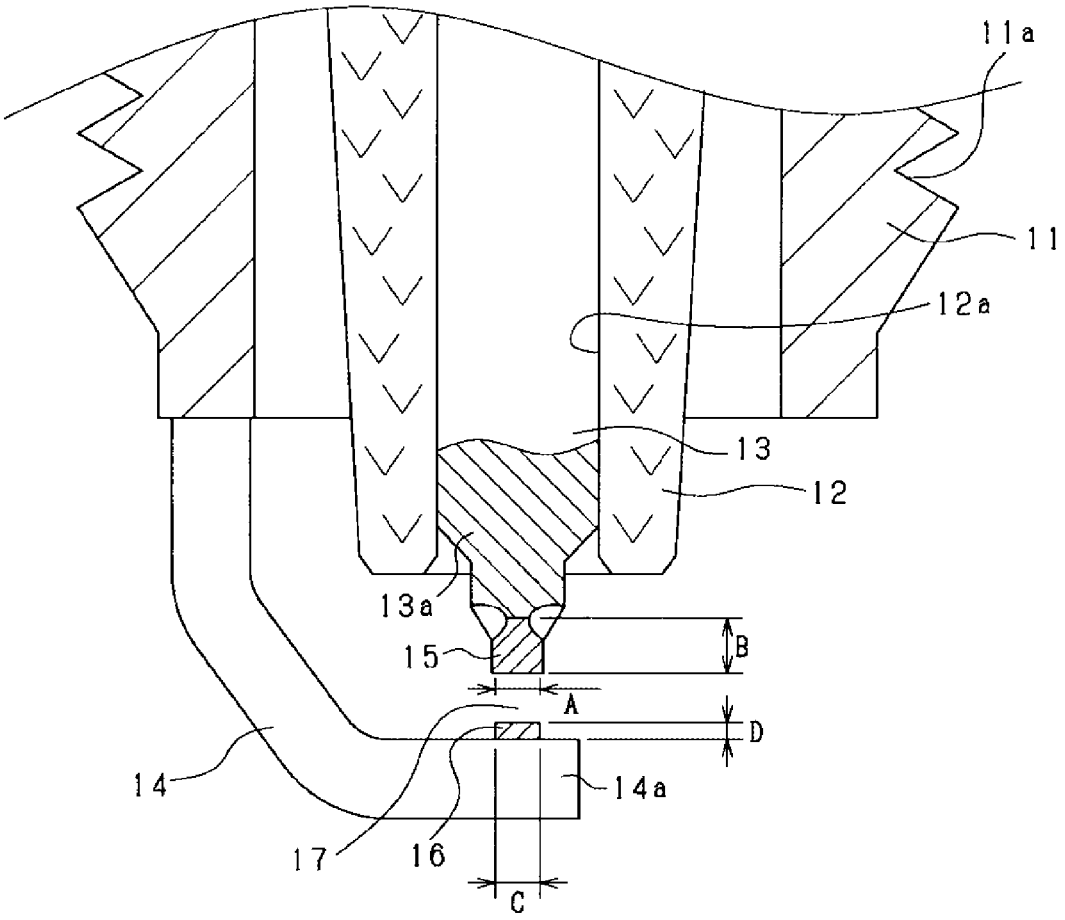
FIG. 2 is a partial enlarged view of FIG. 1.

As illustrated in FIG. 2, a discharge part of the spark plug 10 is constituted by the tip portion 13*a* of the center electrode 13 and a tip portion 14*a* of the ground electrode 14, which faces the tip portion 13*a*. Noble metal chips 15 and 16 are respectively attached to the tip portion 13*a* of the center electrode 13 and the tip portion 14*a* of the ground electrode 14. The noble metal chips 15 and 16 (electrode members) are respectively joined to the tip portions 13*a*, 14*a* through joining processing such as laser welding and resistance welding. A spark gap 17 is formed between the noble metal chip 15 and the noble metal chip 16. That is, a spark is formed by discharge being performed between the noble metal chip 15 and the noble metal chip 16.

The noble metal chips 15 and 16 are both formed in a columnar shape. For example, an outer diameter A of the noble metal chip 15 is 1.0 mm, and a height B is 1.5 mm. An outer diameter C of the noble metal chip 16 is 1.0 mm, and a height D is 0.5 mm.

Returning to FIG. 1, as is known, a central axis 18 and a terminal portion 19 are electrically connected at an upper portion of the center electrode 13. An external circuit which applies a high voltage for spark generation is connected to the terminal portion 19. Further, a gasket 20 to be used for attachment to the internal combustion engine is provided at an upper end portion of the screw portion 11*a* of the housing 11.

The noble metal chips 15 and 16 are formed of an IrRh alloy containing Rh (rhodium) using Ir (iridium) which has a high melting point and which excels in wear resistance as a base, to suppress high-temperature volatility of Ir. The IrRh alloy can suppress oxidation and volatilization of Ir from a crystal grain boundary in a high-temperature gas or in an oxidizing atmosphere. Preferably an IrRh alloy containing 5 to 50 wt % of Rh, more preferably an IrRh alloy containing 5 to 30 wt % of Rh can suppress oxidization and volatilization of Ir from a crystal grain boundary in a high-temperature gas or in an oxidizing atmosphere. The discloser of the present application has found that wear resistance is improved by Ta being added to the IrRh alloy. Note that, in the above-described IrRh alloy, a component except Rh and Ta is Ir.

Figure 3:
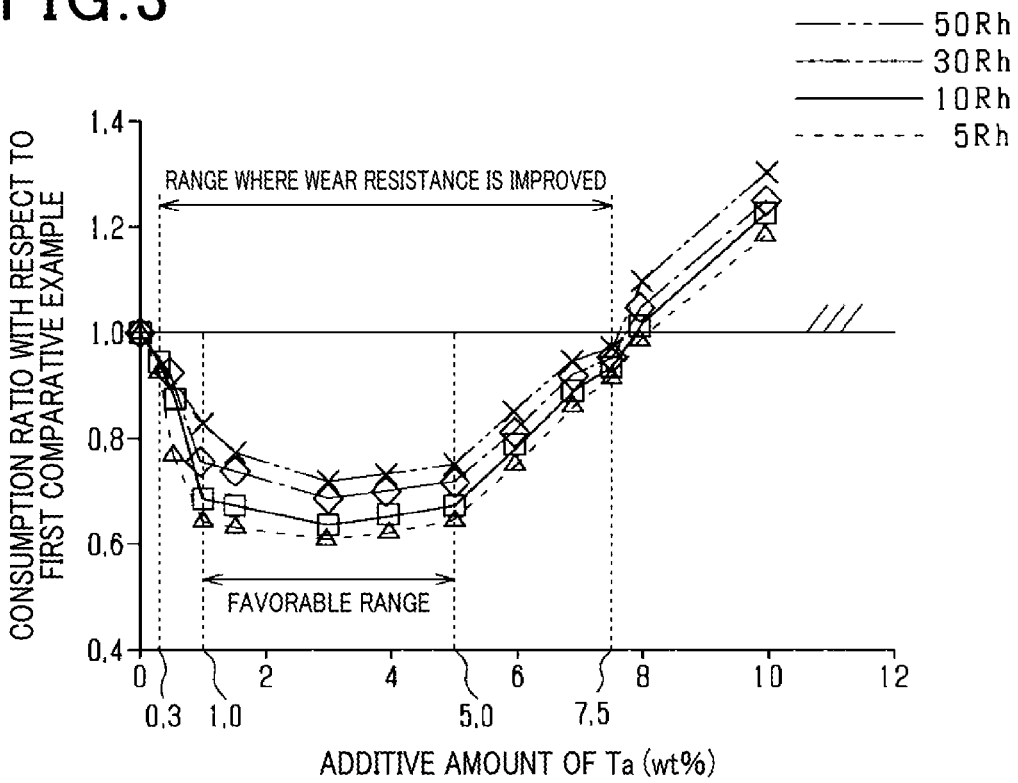
FIG. 3 is a graph indicating a result of a wear resistance test of a noble metal chip of an IrRh alloy to which Ta is added.

FIG. 3 is a graph indicating a result of a wear resistance test of the noble metal chip 15 of the IrRh alloy to which Ta is added. In the wear resistance test, ignition (spark discharge) to a fuel is performed for 50 hours at 5,600 rpm with the spark plug 10 fitted to the internal combustion engine. FIG. 3 indicates a ratio of a consumed amount of the noble metal chip 15 for which an additive amount of Ta is changed while a consumed amount (volume decrease amount) of the noble metal chip 15 in a first comparison example in which Ta is not added is set as 1. FIG. 3 indicates cases where a contained amount of Rh is respectively 5 wt %, 10 wt %, 30 wt % and 50 wt %.

As illustrated in FIG. 3, in all cases where the contained amount of Rh is 5 wt %, 10 wt %, 30 wt % and 50 wt %, the consumed amount of the noble metal chip 15 decreases in a range where the additive amount of Ta is between 0.3 and 7.5 wt %, preferably in a range where the additive amount of Ta is between 0.3 and 6 wt %. Particularly, in a range where the additive amount of Ta is between 1.0 and 5.0 wt %, the consumed amount of the noble metal chip 15 prominently decreases. Because a melting point (3027° C.) of Ta is higher than a melting point (1960° C.) of Rh, it is estimated that melting and scattering of the noble metal chip 15 upon spark discharge can be suppressed.

Note that, if the additive amount of Ta exceeds 6 wt % and becomes equal to or greater than 8 wt %, the consumed amount of the noble metal chip 15 is greater than that in the first comparison example (consumption rate=1). It is believed that this is because wear resistance is lowered due to grain boundaries becoming brittle as a result of Ta segregating at the grain boundary.

Figure 4:
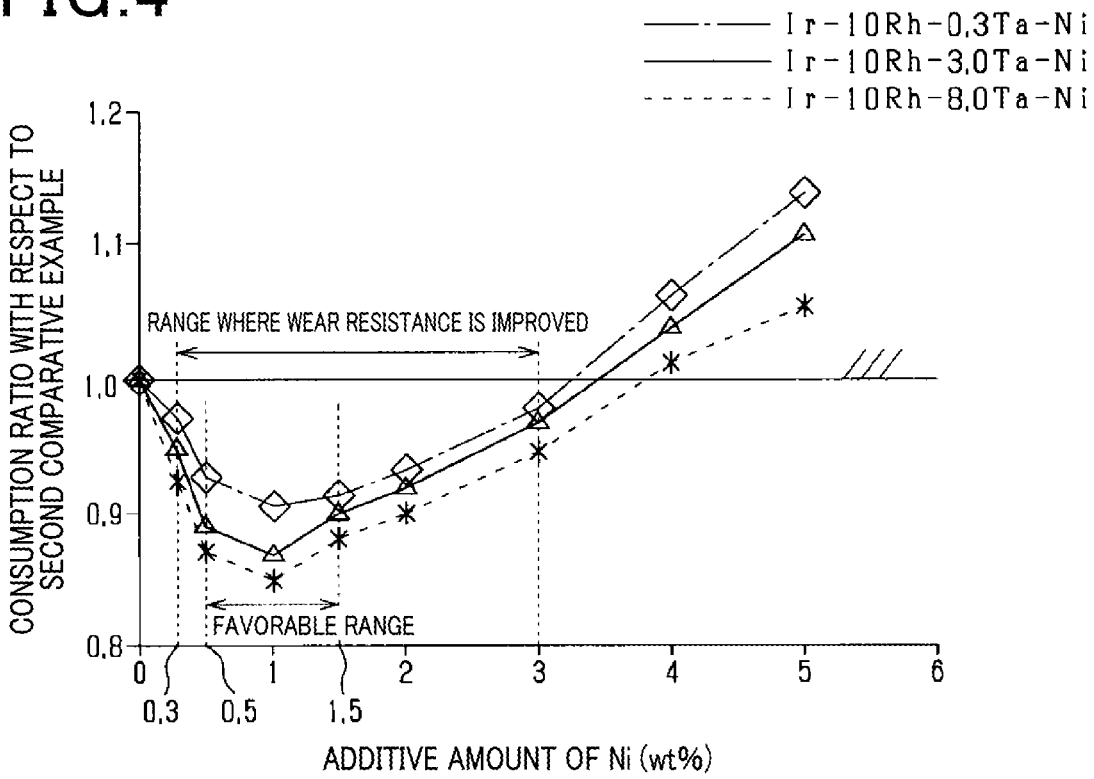
FIG. 4 is a graph indicating a result of a wear resistance test of a noble metal chip of an IrRh alloy to which at least one of Ta and Ni are added.

FIG. 4 is a graph indicating a result of a wear resistance test of the noble metal chip 15 of the IrRh alloy to which Ta and Ni are added. In the wear resistance test, ignition of a fuel is performed for 50 hours at 5,600 rpm with the spark plug 10 fitted to the internal combustion engine. FIG. 4 indicates a ratio of a consumed amount of the noble metal chip 15 for which an additive amount of Ni (nickel) is changed while a consumed amount of the noble metal chip 15 in a second comparative example in which the contained amount of Rh is 10 wt % and Ta is added is set as 1. FIG. 4 indicates cases where the additive amount of Ta is respectively 0.3 wt %, 3.0 wt %, and 8.0 wt %. Note that, in the above-described IrRh alloy, a component except Rh, Ta and Ni is Ir.

As illustrated in FIG. 4, in all cases where the additive amount of Ta is 0.3 wt %, 3.0 wt % and 8.0 wt %, the consumed amount of the noble metal chip 15 decreases in a range where the additive amount of Ni is between 0.3 and 3 wt %. Particularly, in a range where the additive amount of Ni is between 0.5 and 1.5 wt %, the consumed amount of the noble metal chip 15 prominently decreases. It is estimated that volatilization and consumption of Ir due to generation of an oxide can be suppressed by Ni whose melting point of an oxide is high being added.

Note that, if the additive amount of Ni becomes equal to or greater than 4 wt % (exceeds 3 wt %), the consumed amount of the noble metal chip 15 becomes greater than that in the second comparative example. It is believed that this is because melting and scattering of the noble metal chip 15 upon spark discharge increases because the melting point (1450° C.) of Ni is lower than a melting point (2454° C.) of Ir and a melting point (1960° C.) of Rh.

Therefore, in the noble metal chips 15 and 16 in the present embodiment, 0.3 to 7.5 wt % of Ta, preferably 0.3 to 6 wt % of Ta, more preferably 1 to 5 wt % of Ta is added to the IrRh alloy, and preferably the IrRh alloy contains 5 to 50 wt % of Rh, more preferably the IrRh alloy contains 5 to 30 wt % of Rh. Further, in the noble metal chips 15 and 16, 0.3 to 3 wt % of Ni, preferably 0.5 to 1.5 wt % of Ni is added.

The present embodiment which has been described in detail above has the following advantages.

The noble metal chips 15 and 16 are an IrRh alloy, preferably an IrRh alloy contains 5 to 50 wt % of Rh, and more preferably an IrRh alloy contains 5 to 30 wt % of Rh. Therefore, it is possible to further suppress volatilization and consumption of Ir due to generation of an oxide at high temperatures, with Rh which is less likely to volatilize at high temperatures.

In the noble metal chips 15 and 16, 0.3 to 7.5 wt % of Ta, preferably 0.3 to 6 wt % of Ta is added to the above-described IrRh alloy. By equal to or greater than 0.3 wt % of Ta being added to the IrRh alloy, wear resistance is improved. However, if the additive amount of Ta exceeds 6 wt % and becomes equal to or greater than 8 wt %, wear resistance is lowered. Concerning this point, according to the above-described configuration, it is possible to further improve wear resistance of the noble metal chips 15 and 16 (the center electrode 13 and the ground electrode 14).

In the noble metal chips 15 and 16, 1 to 5 wt % of Ta is added. By 1 to 5 wt % of Ta being added to the IrRh alloy, wear resistance is further improved. Therefore, it is possible to further improve wear resistance of the noble metal chips 15 and 16.

In the noble metal chips 15 and 16, 0.3 to 3 wt % of Ni is added. By equal to or greater than 0.3 wt % of Ni being added to a material in which 0.3 to 8 wt % of Ta is added to the IrRh alloy, wear resistance is improved. However, if the additive amount of Ni exceeds 3 wt %, wear resistance is lowered. Concerning this point, according to the above-described configuration, it is possible to further improve wear resistance of the noble metal chips 15 and 16.

In the noble metal chips 15 and 16, 0.5 to 1.5 wt % of Ni is added. By 0.5 to 1.5 wt % of Ni being added to a material in which 0.3 to 8 wt % of Ta is added to the IrRh alloy, wear resistance is further improved. Therefore, it is possible to further improve wear resistance of the noble metal chips 15 and 16.

Note that the above-described embodiment can be changed and implemented as follows. The same reference numerals will be assigned to portions which are the same as those in the above-described embodiment, and description will be omitted.

FIG. 3 indicates a consumed amount of the noble metal chip 15 in which Ta is added to the IrRh alloy. In contrast, it is also possible to provide similar effects even if Nb (niobium) which belongs to the same group 5 element is added in place of Ta. In short, by a total of 0.3 to 7.5 wt %, preferably a total of 0.3 to 6 wt %, more preferably a total of 1 to 5 wt % of at least one of Ta and Nb being added to the IrRh alloy, it is possible to further improve wear resistance of the noble metal chips 15 and 16. Note that, in the above-described IrRh alloy, a component except Rh, Ta and Nb is Ir.

FIG. 4 indicates the consumed amount of the noble metal chip 15 in which Ni is added to a material in which the contained amount of Rh is 10 wt % and Ta is added. In contrast, it is possible to provide similar effects even if Co (cobalt) which has similar chemical properties is added in place of Ni. In short, by a total of 0.3 to 3 wt %, preferably a total of 0.5 to 1.5 wt % of at least one of Ni and Co being added to a material in which a total of 0.3 to 7.5 wt %, preferably a total of 0.3 to 6 wt % of at least one of Ta and Nb is added to the IrRh alloy, it is possible to further improve wear resistance of the noble metal chips 15 and 16. Note that, in the above-described IrRh alloy, a component except Rh, Ta, Nb, Ni and Co is Ir. Further, it is estimated that volatilization and consumption of Ir due to generation of an oxide can be suppressed also by Cr (chrome) and Re (rhenium) being added. Therefore, by a total of 0.3 to 3 wt %, preferably a total of 0.5 to 1.5 wt % of at least one of Ni, Co and Cr being added to a material in which a total of 0.3 to 7.5 wt %, preferably a total of 0.3 to 6 wt % of at least one of Ta, Nb and Re is added to the IrRh alloy, it is possible to further improve wear resistance of the noble metal chips 15 and 16. Note that, in the above-described IrRh alloy, a component except Rh, Ta, Nb, Re, Ni, Co and Cr is Ir.

It is also possible to form the whole of the tip portion 13*a* (electrode member) of the center electrode 13 with a material which is the same as that of the noble metal chip 15.

It is also possible to form the whole of the tip portion 14*a* (electrode member) of the ground electrode 14 with a material which is the same as that of the noble metal chip 16.

It is also possible to provide an electrode member corresponding to the noble metal chips 15 and 16 at one of the tip portion 13*a* (discharge part) of the center electrode 13 and the tip portion 14*a* (discharge part) of the ground electrode 14.

While the present disclosure has been described with reference to the examples, it is understood that the present disclosure is not limited to the examples and structures. The present disclosure incorporates various modified examples and modifications within an equivalent range. In addition, various combinations, forms, and other combinations and forms including only one element or more or less elements fall within the scope and the scope of mind of the present disclosure.

What is claimed is:

1. A spark plug electrode, comprising an electrode member, in which a total of 0.3 to 7.5 wt % of at least one of Ta and Nb is added to an IrRh alloy, is provided at a discharge part, wherein a total of 0.3 to 3 wt % of at least one of Ni and Co is added to the electrode member.

2. The spark plug electrode according to claim 1, wherein the IrRh alloy contains 5 to 50 wt % of Rh.

3. The spark plug electrode according to claim 1, wherein a total of 1 to 5 wt % of at least one of Ta and Nb is added to the electrode member.

4. The spark plug electrode according to claim 1, wherein a total of 0.5 to 1.5 wt % of at least one of Ni and Co is added to the electrode member.

5. A spark plug comprising the spark plug electrode according to claim 1.

6. A spark plug electrode, comprising an electrode member, in which a total of 0.3 to 6 wt % of at least one of Ta and Nb is added to an IrRh alloy containing 5 to 30 wt % of Rh, is provided at a discharge part, wherein a total of 0.3 to 3 wt % of at least one of Ni and Co is added to the electrode member.

7. A spark plug electrode, comprising an electrode member, in which 0.3 to 7.5 wt % of Ta is added to an IrRh alloy, is provided at a discharge part, wherein a total of 0.3 to 3 wt % of at least one of Ni and Co is added to the electrode member.

8. The spark plug electrode according to claim 7, wherein the IrRh alloy contains 5 to 50 wt % of Rh.

9. The spark plug electrode according to claim 7, wherein 1 to 5 wt % of Ta is added to the electrode member.

10. A spark plug electrode, comprising an electrode member, in which 0.3 to 6 wt % of Ta is added to an IrRh alloy containing 5 to 30 wt % of Rh, is provided at a discharge part, wherein a total of 0.3 to 3 wt % of at least one of Ni and Co is added to the electrode member.

* * * * *